US005950857A

United States Patent [19]

Rosen

[11] Patent Number: 5,950,857

[45] Date of Patent: Sep. 14, 1999

[54] LEAK RESISTANT AND SQUEEZE RESISTANT LIQUID BOX CONTAINER

[76] Inventor: Jay B. Rosen, 115 Chinaberry Dr., Lafayette Hill, Pa. 19444

[21] Appl. No.: 09/099,886

[22] Filed: Jun. 17, 1998

[51] Int. Cl.[6] ..... B65D 21/02

[52] U.S. Cl. ..... 220/23.91; 220/714; 220/717; 220/740; 220/23.83; 215/10; 215/388

[58] Field of Search ..... 220/714, 715, 220/717, 719, 740, 737, 742, 23.83, 23.86, 23.87, 23.91; 222/482, 490, 494, 544, 183, 131; 215/387, 388, 389, 10, 11.1, 11.5, 12.1

[56] References Cited

U.S. PATENT DOCUMENTS

| | | | |
|---|---|---|---|
| 3,739,938 | 6/1973 | Paz | 220/715 |
| 4,561,560 | 12/1985 | Lyon | 220/278 |
| 4,946,062 | 8/1990 | Coy | 220/90.4 |
| 4,949,878 | 8/1990 | Jacobi | 222/482 |
| 4,974,744 | 12/1990 | Shanklin et al. | 220/278 |
| 4,986,435 | 1/1991 | Wright | 220/85 |
| 5,025,945 | 6/1991 | Lyon | 220/740 |
| 5,052,575 | 10/1991 | Ravreby | 220/278 |
| 5,150,811 | 9/1992 | Kelston | 220/740 |
| 5,186,347 | 2/1993 | Freeman et al. | 220/254 |
| 5,238,140 | 8/1993 | Maze | 220/506 |
| 5,265,757 | 11/1993 | Wu | 220/707 |
| 5,292,021 | 3/1994 | Lyon | 220/253 |
| 5,458,263 | 10/1995 | Ciammitti et al. | 222/183 |

FOREIGN PATENT DOCUMENTS

| | | | |
|---|---|---|---|
| 94001026 | 1/1994 | WIPO | 220/707 |

*Primary Examiner*—Stephen Castellano
*Attorney, Agent, or Firm*—Ratner & Prestia

[57] ABSTRACT

A leak resistant drink box holder for containing a drink box. The drink box holder includes a container having four sidewalls and a floor forming an internal cavity of a size to fit a substantial portion of the drink box. A lid that is sealably engageable with the container has an air inlet opening, an air regulating valve and a drinking spout with a fluid exit opening. The drinking spout is adapted to apply a suction from a user's mouth. A liquid outlet regulating valve is sealably engageable with the drinking spout. A straw have first and second ends is sealably engaged with the liquid outlet regulating valve at one end and is adapted to fit within the drink box at the other end.

20 Claims, 4 Drawing Sheets

LEAK RESISTANT AND SQUEEZE RESISTANT LIQUID BOX CONTAINER

FIELD OF THE INVENTION

The present relates to liquid or drink cartons or boxes. More specifically, the present invention relates to a leak resistant and squeeze resistant container for drink boxes.

BACKGROUND OF THE INVENTION

Liquid boxes or cartons are a popular container form that provide single servings of drinks such as juices, lemonade, ice tea and milk. They are commonly referred to as "juice boxes," or "drink boxes."

Juice boxes come in a variety of sizes, unrelated to the contents of the juice box. A standard large size juice box is approximately 4 3/16" (H)×2 1/8" (W)×1 7/16" (D). A standard small size juice box is approximately 3 5/16" (H)×2" (W)× 1 3/16" (D). Juice boxes typically come packaged with a straw separately sealed in plastic packaging, attached to and removable from the juice box. The attached straw typically has two rigid sections connected by a flexible, accordion section. One rigid section ends in an angled-cut piercing end, while the other rigid section ends in a straight-cut drinking end. The piercing end of this straw is designed to pierce a small foiled sealed opening located near a corner on the top of the juice box. Because the contents of the juice boxes are ultra-pasteurized and sealed, refrigeration is not necessary until opened. Because juice boxes are typically single servings, refrigeration is usually not required.

Although convenient to store, transport and use, juice boxes present several disadvantages. The main disadvantage of juice boxes is their tendency to leak through the straw, if the juice box sides are squeezed together. This problem is particularly troublesome when the straw is first inserted through the juice box, as some force is necessary to hold the pressurized juice box while the straw is being inserted. Once the straw is inserted through the foil seal, if the juice box is tilted a sufficient amount, the liquid contents may leak through the straw. Turning the juice box on its side sometimes results in the liquid contents leaking out between the outside wall of the straw and the foil material which was pierced by the straw.

Each of these disadvantages can be exacerbated by young children who commonly use juice boxes. An additional disadvantage, particularly evident for young children, is the need for an adult to prepare the juice box for drinking by removing the straw and inserting the straw into the juice box. Although spoilage is a possibility once the juice box is opened, the contents can usually be kept without refrigeration for several hours after opening. In certain situations, such as while driving a car, it would be convenient to have a juice box "ready to go," prior to driving, instead of fumbling to ready the juice box for drinking, while driving.

"Sealed drinking cups, such as the Spill-Proof Cup sold by Playtex are commonly used with young children to provide liquids and minimize the chance of spillage. These cups are often referred to as "sippy cups." Sippy cups have a spring loaded sealing mechanism or plastic sealing mechanism that allows a user to drink liquids from the sealed container, by applying a suction to a drinking spout. Sippy cups make no provision, however, for the shape and manner of drinking required of drink boxes.

SUMMARY OF THE INVENTION

The present invention involves a leak resistant drink box holder for holding a drink box. The drink box holder includes a container having four sidewalls and a floor forming an internal cavity of a size to fit a substantial portion of the drink box. A lid that is, sealably engageable with the container has an air inlet opening, an air regulating valve and a drinking spout with a fluid exit opening. The drinking spout is adapted to permit a suction from a user's mouth. A liquid outlet regulating valve is sealably engageable with the drinking spout. A straw having first and second ends is sealably engaged with the liquid outlet regulating valve at one end and is adapted to fit within the drink box at the other end.

BRIEF DESCRIPTION OF THE FIGURES

The present invention will now be described by way of non-limiting example, with reference to the attached drawings in which.

DETAILED DESCRIPTION OF THE INVENTION

Figure 1:
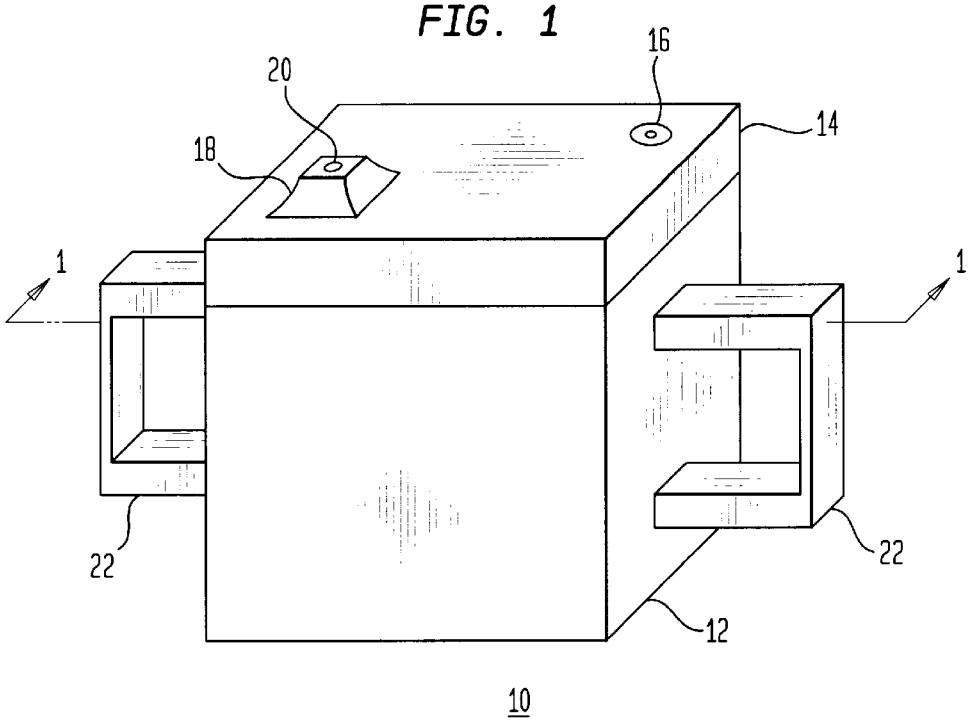
FIG. 1 is a perspective view of a leak resistant and squeeze resistant liquid box container in accordance with the present invention.

There is shown in FIG. 1 an exemplary embodiment of a leak resistant drink box holder 10 in accordance with the present invention. Drink box holder 10 is comprised of a container section 12 and a lid section 14. Lid section 14 has an air inlet opening 16 and a drinking spout 18. Located at the top of drinking spout 18 is a fluid exit opening 20. At drinking spout 18 is adapted to fit inside of a user's mouth, so that a suction can be created by the user.

Also shown in FIG. 1 are optional side handles 22. Side handles 22 are optionally attached to container 12 either singlely (not shown) or in pairs. Referring to the cross sectional view shown in FIG. 2, a juice box 24 is shown by dotted line within the leak resistant drink box holder 10. The majority of juice box 24 is contained within container 12. Container 12 approximates the substantially rectangular shape of juice box 24 and is defined by four sidewalls and a floor (or bottom). The top portion of container 12 is open to allow for the easy insertion and removal of juice box 24.

In an exemplary embodiment, leak resistant drink box holder 10 is sized to fit a standard large size juice box. In this way, a smaller juice box could also be used with leak resistant drink box holder 10. In order for a standard large juice box 24 to fit within leak resistant drink box holder 10, container section 12 and lid section 14 must be slightly larger than the dimensions of the standard large juice box with which the holder 10 will be used.

Lid 14 contains an air inlet valve 25 to allow air to enter the interior cavity of holder 10 when suction is applied by a user's mouth through drinking spout 18. Air inlet valve 25 is contained within substantially cylindrical air tube 26. Air tube 26 extends downward from the inside roof surface of lid 14. Air tube 26 is positioned so that air inlet opening 16 opens into a first end of air tube 26. The opposite end of air tube 26 is fitted with a spring mount 32. A first end of spring 34 is connected to spring mount 32. The second end of spring 34 is connected to a plunger 30. In this way, when a suction is applied by a user through drinking spout 18, a suction causes plunger 30 to move downward, away from air inlet opening 16, allowing air to enter and force the liquid contained within juice box 24 up through straw 42, through liquid outlet regulating valve 27 and through fluid exit opening 20 into the user's mouth.

In an exemplary embodiment, plunger 30 is made of either rubber or plastic or rubber-like or plastic-like materials. Plunger 30 is designed to seal against air inlet opening 16 and can be made from materials suitable for this purpose as understood by those skilled in the art.

Figure 2:
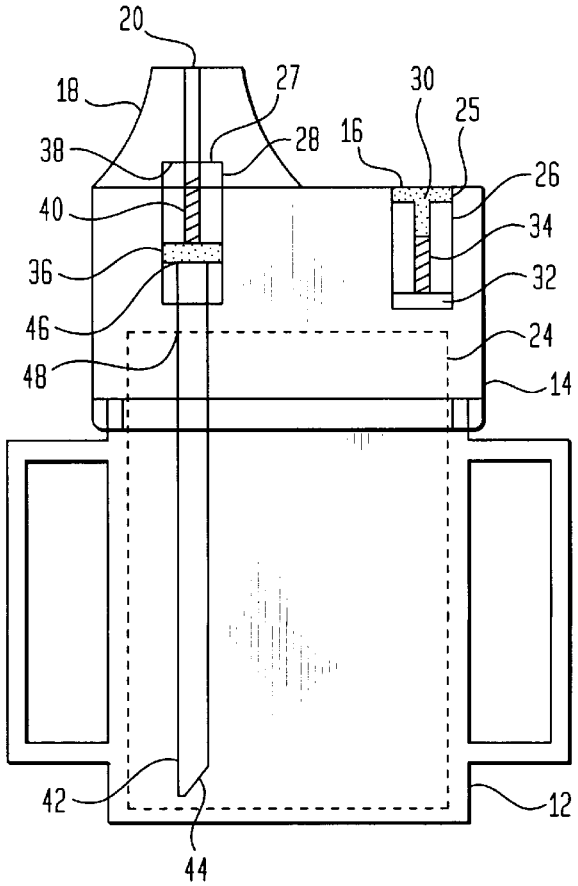
FIG. 2 is a cross sectional view of the exemplary embodiment shown in FIG. 1.

Liquid outlet regulating valve 27 operates in a similar fashion to that of air inlet valve 25. Liquid outlet regulating valve 27 is contained within substantially cylindrical tube 28. A first end of liquid tube 28 extends from the inside upper portion of lid 14 in a similar fashion to that of air tube 26. In FIG. 2 liquid tube 28 is shown extending into drinking spout 18. This is an exemplary embodiment and not a requirement of the present invention. A first end of spring 40 is attached to spring mount 38. A second end of spring 40 is attached to plunger 36. Plunger 36 is sealably engageable with first end 46 of straw 42. Upon application of a suction through drinking spout 18 by a user, plunger 36 is drawn upward away from opening 46 of straw 42. This causes a pressure differential within the internal cavity of holder 10 causing plunger 30 to move allowing air to flow in through air inlet opening 16. This, in turn, causes liquid contained within juice box 24 to flow up through straw 42 through liquid outlet regulating valve 27 and out through liquid exit opening 20 into a user's mouth.

Figure 3:
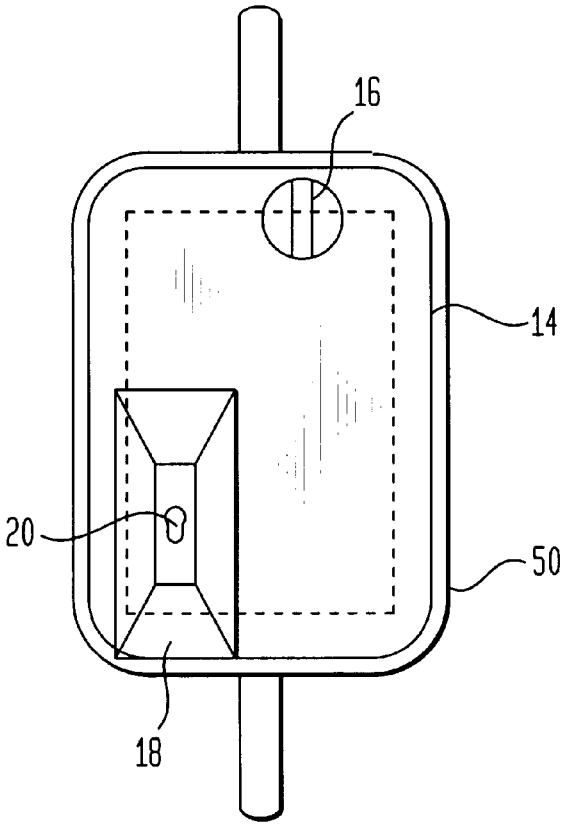
FIG. 3 is a top view of the exemplary embodiment shown in FIG. 1.

FIG. 3 shows a top view of lid 14 with closure member 50. Closure member 50 is one half of an offsetting lip closure which can be used in an exemplary embodiment of the present invention. Once a juice box 24 is inserted into container 12, it is necessary to form a leak resistant seal between lid 14 and container 12. In an exemplary embodiment, an offsetting lip closure is used to mate lid 14 with container 12. In this exemplary embodiment, lid 14 and container 12 are not connected. The offsetting lip closure in an exemplary embodiment is a common seal used in food containers as well as other containers. Examples of such seals can be found in products manufactured by Rubbermaid®, TUPPERWARE® and food container products of other manufacturers, as will be recognized and understood by those skilled in the art. Illustrations of the lid seal 50 and the container seal 52 are shown in FIGS. 4 and 5.

Figure 4:
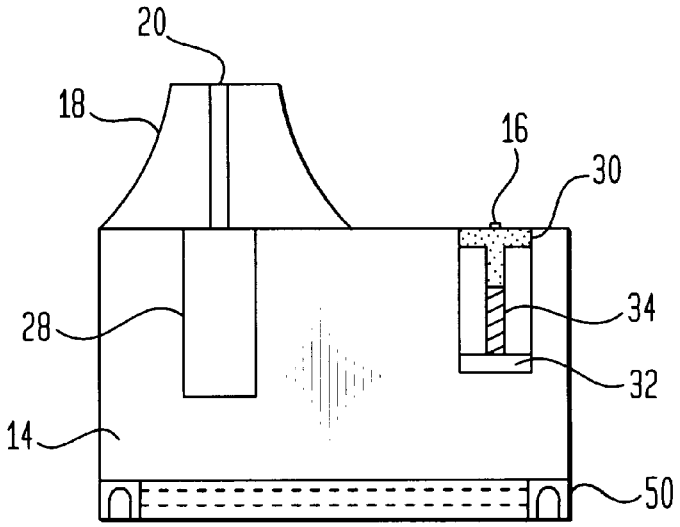
FIG. 4 is a cross sectional view of the lid of the exemplary embodiment shown in FIG. 1.
Figure 5:
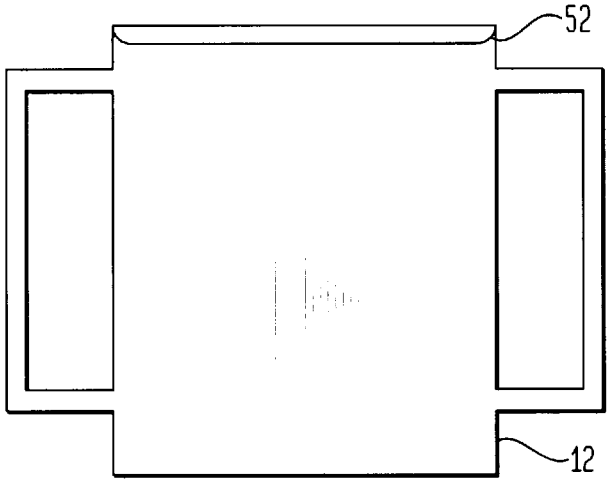
FIG. 5 is a cross sectional view of the container portion of the exemplary embodiment shown in FIG. 1.
Figure 6:
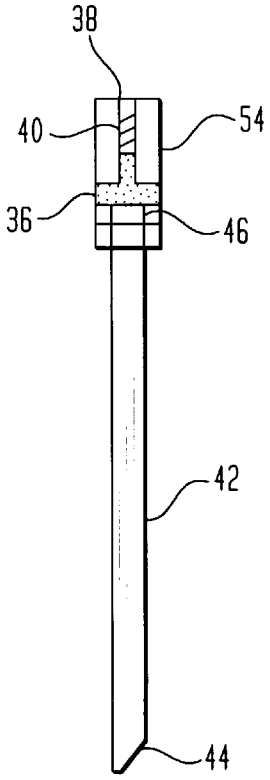
FIG. 6 is a cross sectional view of a straw engaged with a liquid outlet regulating value in accordance with the present invention.

Also shown in FIG. 4 is liquid tube 28 without liquid outlet regulating valve 27. In an alternative embodiment, liquid outlet regulating valve 27 is contained as a separate unit, sealably insertable within liquid 28, as shown in FIG. 6. A separate, inner cylindrical tube member 54 contains spring mount 38, spring 40 and plunger 36. Inner cylindrical tube 54 is meant to fit tightly within tube 28 so that it does not slip out and at the same time, forms a seal so that air does not flow between the outer wall cylindrical tube 54 and inner wall of cylindrical tube 28. Straw 42 is shown inserted within tube 54.

Figure 7:
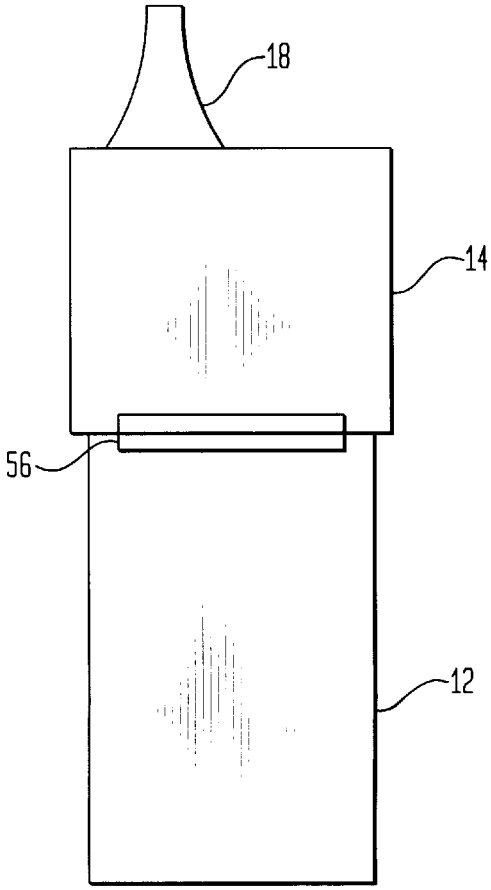
FIG. 7 is a side view showing an alternative embodiment of the present invention.

There is shown in FIG. 7 an additional embodiment of the present invention. FIG. 7 shows a hinged 56 connecting lid 14 and container 12. Hinged 56 is shown as a membering type hinge. Other hinge types, such as those commonly referred to as piano hinges could also be used.

Figure 8:
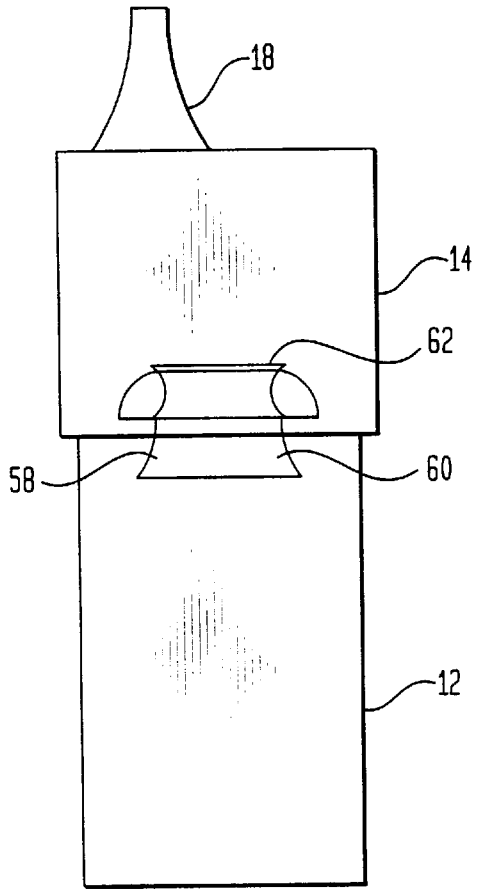
FIG. 8 is a side view showing a bayonet closure for an alternative embodiment of the present invention.

There is shown in FIG. 8, a bayonet snap closures 58, comprised of a bayonet end 60 and receiving end 63. Bayonet snap closure 58 can be used singlely in combination with a hinge 56. Bayonet snap closure 58 can be used in pairs, one on each side of holder 10.

Figure 9:
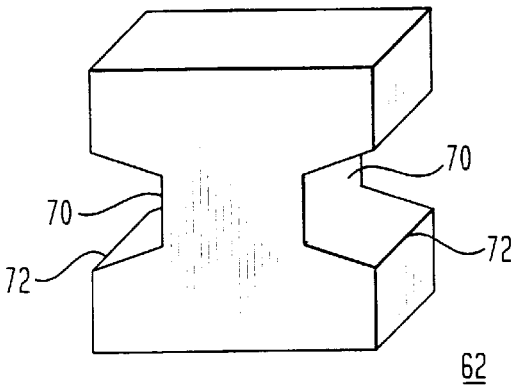
FIGS. 9 and 10 are the male and female ends of the bayonet closure shown in FIG. 8.
Figure 10:
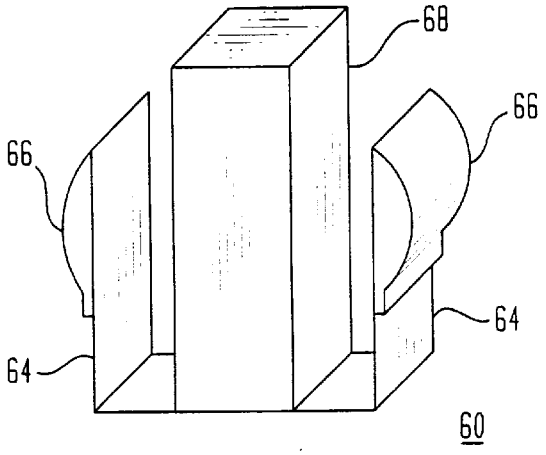

There is shown in FIGS. 9 and 10 a bayonet snap closure 58, comprised of receiving end 62 and a bayonet end 60. In an exemplary embodiment, bayonet end 60 is comprised of two spring member 64, each having an extension piece 66. A guide piece 68 is used to guide bayonet 60 into receiving end 62. Upon insertion into receiving end 62, extensions 66 of spring member 64 are forced outward through opening 70, engaging sidewall ends 72 to prevent removal. In order to remove bayonet end 60 from receiving end 62, spring member 64 must be compressed by pushing on extensions 66 so that the outer edge of extensions 66 are within the plane of the sidewalls of receiving end 62.

Except for springs 40 and 34 which are made of a rust resistant metal such as stainless steel, all other components described above can be made of plastic or plastic like material, manufactured by injection molding or other plastic forming process. The liquid outlet value assembly can also be plastic or a plastic like material with a slot that opens the valve suction.

While particular embodiment of the present invention have been disclosed herein, it is not intended to limit the invention to such disclosure. Changes and modifications may be incorporated and embodied within the scope of the following claims.

What is claimed:

1. A leak resistant drink box holder to contain a drink box comprising:

a) a container having four sidewalls and a floor, forming an internal cavity of a size to fit a substantial portion of said drink box;

b) a lid sealably engageable with said container, having an air inlet opening, an air inlet regulating valve and a drinking spout having a fluid exit opening, adapted to permit a suction created from a user's mouth;

c) a liquid outlet regulating valve sealably engageable with said drinking spout; and d) a straw having first and second ends, said first end adapted to sealably engage with said liquid outlet regulating valve and said second end adapted to fit within said drink box.

2. A leak resistant drink box holder in accordance with claim 1, further comprising a locking means for securely attaching said lid to said container.

3. A leak resistant drink box holder in accordance with claim 2, wherein said locking means is an offsetting lip closure.

4. A leak resistant drink box holder in accordance with claim 2, further comprising a hinge connecting said lid to said container and wherein said locking means comprises a bayonet snap closure.

5. A leak resistant drink box holder in accordance with claim 1, wherein said lid further comprises a substantially cylindrical shaped air tube attached perpendicular to the plane of said lid with said air inlet opening, opened into a first end of said air tube and said air inlet regulating valve comprises:

a) a spring mount, fitted into said air tube at a second end of said air tube;

b) a plunger positioned between said spring mount and said air inlet opening and sealable against said air inlet opening; and c) a spring having first and second ends, connected to said spring mount at said first end and connected to said plunger at said second end, wherein said suction, applied through said drinking spout, causes said plunger to compress said spring, allowing air to enter through said air inlet opening.

6. A leak resistant drink box holder in accordance with claim 5 wherein said plunger is a rubber like material.

7. A leak resistant drink box holder in accordance with claim 5 wherein said air inlet regulating valve is removable from said air tube.

8. A leak resistant drink box holder in accordance with claim 7 wherein said air inlet regulating valve is removable as a single unit.

9. A leak resistant drink box holder in accordance with claim 1 wherein said lid further comprises a substantially cylindrical shaped liquid tube attached perpendicular to the plane of said lid, with said fluid exit opening, opened into a first end of said liquid tube, and said liquid outlet regulating valve comprises:

a) a spring mount, fitted into said liquid tube;

b) a plunger positioned between said spring mount and said first end of said straw, sealable against said end of said straw;

c) a spring having first and second ends connected to said plunger at said first end and connected to said spring mount at said second end;

wherein said spring maintains said plunger sealably against said straw until a suction, applied through said drinking spout, causes said plunger to compress said spring, allowing liquid to enter through said straw.

10. A leak resistant drink box holder in accordance with claim 9 wherein said plunger is a rubber like material.

11. A leak resistant drink box holder in accordance with claim 9 wherein said liquid outlet regulating valve is removable from said liquid tube.

12. A leak resistant drink box holder in accordance with claim 11 wherein said liquid outlet regulating valve is removable as a single unit.

13. A leak resistant drink box holder in accordance with claim 9, wherein said first end of said straw is removably fitted to said second end of said liquid tube.

14. A leak resistant drink box holder in accordance with claim 1 wherein one end of said straw is adapted to pierce said juice box.

15. A leak resistant drink box holder in accordance with claim 1 further comprising at least one handle attached to at least one of said container sidewalls.

16. A leak resistant drink box holder in accordance with claim 5 wherein said plunger is a plastic like material.

17. A leak resistant drink box holder in accordance with claim 14 wherein said straw has an angled cross section adapted to pierce said drink box.

18. A leak resistant drink box holder in accordance with claim 1 wherein said liquid outlet valve includes a slot that opens upon suction from a user's mouth.

19. A leak resistant drink box holder in accordance with claim 1 further comprising a juice box, fitted within said container with said second end of said straw fitted within said juice box.

20. A leak resistant drink box holder to contain a drink box comprising:

a) a container having four sidewalls and a floor, forming an internal cavity of a size to fit a substantial portion of said drink box;

b) a lid sealably engageable with said container, having an air inlet opening, a substantially cylindrical shaped air tube attached to said lid perpendicular to the plane of said lid with said air inlet opening opened into a first end of said air tube, a removable air inlet regulating valve comprising:

i) a spring mount, fitted into said air tube at a second end of said air tube, ii) a plunger positioned between said spring mount and said air inlet opening and sealable against said air inlet opening, and iii) a spring having first and second ends, connected to said spring mount at said first end and connected to said straw at said second end, wherein said suction, applied through said drinking spout, causes said plunger to compress said spring, allowing air to enter said air inlet opening; and a drinking spout having a fluid exit opening, adapted to permit a suction created from a user's mouth;

c) a substantially cylindrical shaped liquid tube attached to said lid perpendicular to the plane of said lid with said fluid exit opening opened into a first end of said liquid tube and a liquid outlet regulating valve sealably engageable with said drinking spout comprising:

i) a spring mount, fitted into said liquid tube;

ii) a plunger positioned between said spring mount and said first end of said straw, sealable against said end of said straw;

iii) a spring having first and second ends connected to said plunger at said first end and connected to said spring mount at said second end;

wherein said spring maintains said plunger sealably against said straw until a suction, applied through said drinking spout, causes said plunger to compress said spring, allowing liquid to enter said straw; and d) a straw having first and second ends, said first end adapted to sealably engage with said liquid outlet regulating valve and said second end is angled to pierce and adapted to fit within said drink box.

* * * * *

UNITED STATES PATENT AND TRADEMARK OFFICE

CERTIFICATE OF CORRECTION

PATENT NO. : 5,950,857
DATED : September 14, 1999
INVENTOR(S) : Rosen

It is certified that error appears in the above-identified patent and that said Letters Patent is hereby corrected as shown below:

In column 5, line 37, of the Letters Patent please delete "through".

Signed and Sealed this

Eleventh Day of April, 2000

*Attest:*

*Attesting Officer*

Q. TODD DICKINSON

*Director of Patents and Trademarks*